United States Patent [19]

Peyre

[11] Patent Number: 4,656,903

[45] Date of Patent: Apr. 14, 1987

[54] CUTTER FOR CUTTING MATERIAL IN TAPE FORM

[75] Inventor: Jacques Peyre, Paris, France

[73] Assignee: SMH Alcatel, Paris, France

[21] Appl. No.: 770,919

[22] Filed: Aug. 30, 1985

[30] Foreign Application Priority Data

Aug. 31, 1984 [FR] France ..... 84 13515

[51] Int. Cl.[4] ..... B26D 1/38

[52] U.S. Cl. ..... 83/199; 83/580; 83/611

[58] Field of Search ..... 83/196, 199, 200, 595, 83/610, 611, 580, 673

[56] References Cited

U.S. PATENT DOCUMENTS

| | | | |
|---|---|---|---|
| 1,849,443 | 3/1932 | Wheeler, Jr. et al. | 83/196 |
| 4,063,481 | 12/1977 | Raudys | 83/199 |
| 4,412,466 | 11/1983 | Jurkowski | 83/200 |
| 4,493,236 | 1/1985 | Toth | 83/611 |
| 4,531,437 | 7/1985 | Szablak et al. | 83/199 |

FOREIGN PATENT DOCUMENTS

| | | | |
|---|---|---|---|
| 401623 | 9/1909 | France | 83/611 |
| 1032949 | 6/1966 | United Kingdom . | |

*Primary Examiner*—Frank T. Yost

*Assistant Examiner*—Hien H. Phan

*Attorney, Agent, or Firm*—Sughrue, Mion, Zinn, Macpeak and Seas

[57] ABSTRACT

A cutter for cutting material in tape form comprises a movable blade of circular segment shape in cross-section and a fixed blade. The movable blade is coupled to a rotating shaft so as to move it in front of the fixed blade. A first support carrying the fixed blade is U-shaped in cross-section, the inside of its bottom being semi-circular. A longitudinal first opening intersects the bottom of the first support and a groove opens laterally into this first opening in its groove surface, the groove accommodating the fixed blade. An auxiliary support is generally trough-shaped and has a bottom which is semi-circular on the inside. A second opening intersects the bottom of the auxiliary support, the edges of which are inserted between the sides of the U shape of the first support. A substantially cylindrical housing for the movable blade is defined between the first and auxiliary supports. Snap-fastener means maintain pressure on the first and auxiliary supports to permit rotation of the movable blade in this housing without axial play. The movable blade is operated to close off the first opening when the cutter is closed and to move to the same side as the first and second openings without closing them off when the cutter is open.

9 Claims, 9 Drawing Figures

CUTTER FOR CUTTING MATERIAL IN TAPE FORM

BACKGROUND OF THE INVENTION

1. Field of the Invention

The present invention concerns a cutter for removing successive labels from a tape, specifically intended for equipping an automatic label dispenser in a postal franking machine.

2. Description of the Prior Art

A cutter of this kind has a movable blade which is moved in front of a fixed blade mounted on a support to take up a closed position to cut the tape and an open position for allowing a length of tape equal to the length of a label to pass. A cutter of this kind may be controlled, via the movable blade, from a rotating shaft by means of a crank and crankshaft coupling system between the shaft and the movable blade.

An object of the present invention is to permit a relative disposition of the blades which is very simple and without play in time during the closing of the movable blade on the fixed blade.

SUMMARY OF THE INVENTION

The present invention consists in a cutter for cutting material in tape form, comprising a movable blade of circular segment shape in cross-section, a fixed blade, a rotating shaft, means for coupling said movable blade to said rotating shaft so as to move it in front of said fixed blade, a first support carrying said fixed blade which is U-shaped in cross-section and has a semicircular inside cross-section at the bottom, a longitudinal first opening intersecting its bottom and a groove opening laterally into said first opening in its inside surface, adapted to accommodate said fixed blade, an auxiliary support which is generally trough-shaped and has a bottom which is semi-circular at its inside, a second opening intersecting said bottom and edges inserted between the sides of the U shape of said first support, a substantially cylindrical housing for said movable blade defined between said first and auxiliary supports and snap-fastener means for maintaining pressure on said first and auxiliary supports to permit rotation of said movable blade in said housing without axial play, wherein said movable blade is operated to close off said first opening when the cutter is closed and to move to the same side as the first and second openings without closing them off when the cutter is open.

In accordance with one characteristic of the invention, the cross-section of said movable blade increases in size from one end thereof to the other.

According to another characteristic of the invention, said movable blade is mounted on a second support, said mobile blade being attached at its ends to its support and forming with it two end rings for centering and longitudinally positioning it in said cylindrical housing, being spaced from its support between said rings.

Said second support is of circular sector shape in cross-section.

Said auxiliary support features fastening lugs bordering it externally, being offset from the trough that it forms, and the first support features complementary pegs on its outside surfaces, for engaging them snap-fastener fashion under pressure.

The movable blade is operated by a crank and crankshaft system coupling it to said rotating shaft.

Other characteristics and advantages of the present invention will emerge from the following description of an embodiment of the invention given by way of non-limiting example with reference to the accompanying drawings.

DESCRIPTION OF THE PREFERRED EMBODIMENT

Figure 2:
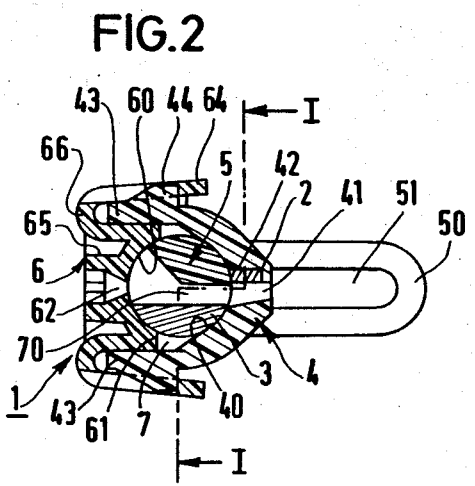
FIG. 2 is a view of the cutter in cross-section on the line II—II in FIG. 1, showing it open.

With reference to FIGS. 1, 2, 3 and 4, it is seen that the cutter 1 comprises a fixed blade 2 and a movable blade 3.

The fixed blade is of rectangular cross-section and the movable blade of semicircular cross-section. The movable blade is moved in front of the fixed blade to allow tape to pass between them when the cutter is open (FIG. 2) or so as to have their facing edges applied one against the other (FIG. 3) to cut the aforementioned tape to remove a label, this tape not being shown in order to simplify the figures.

The fixed blade 2 is mounted on a support 4 called the first support. The support 4 is shown in isolation in FIG. 4, corresponding to a cross-sectional view from below of FIG. 1.

The support 4 is generally U-shaped in cross-section, with the bottom 40 semicircular on the inside. It features a longitudinal opening 41 which intersects the bottom of the U shape in the middle; the length of this opening is at least equal to the width of the tape and one edge of the opening diverges in the direction towards the inside of the cutter. The support 4 also features a longitudinal groove 42 on its inside surface, extending slightly beyond the opening 41 on each side thereof and opening laterally into the other edge of the opening 41. This groove 42 constitutes a housing for the fixed blade of rectangular cross-section. The sides 43 of U-shaped first support 4 carry on the outside a series of pegs 44. Also, at one end, the bottom of the U shape features a groove 45 on the inside. This groove 45 is provided for positioning the movable blade.

The movable blade 3 is mounted on its own support 5 called the second support; this assembly will be described hereinafter with reference to FIGS. 5 through 8. They form a generally cylindrical overall assembly and are not in contact with one another over at least the width of the tape. This assembly carries at one end an operating link 50 extending perpendicular to the blade 3 and its support 5 and featuring an oblong opening 51.

The movable blade 3 and its support 5 are held against the bottom of the first support 4 by an auxiliary support 6 which defines with the support 4 a substantially cylindrical housing 7.

This auxiliary support 6 is substantially trough-shaped with a bottom 60 which is semi-circular on the inside and edges 61 which are inserted between the ends of the sides 43 of the U-shaped first support 4. The facing bottoms 40 and 60 of the supports 4 and 6, which have the same radius, define between them the housing 7. It also features a longitudinal opening 62 intersecting its bottom in the middle; this opening faces the opening 41 with which it communicates in the cutter by virtue of the gap 70 between the movable blade 3 and its support 5 when the cutter is open (FIG. 2).

The auxiliary support 6 is laterally bordered on each side by a series of lugs 64 which fasten over the pegs 44 on the first support 4. These lugs 64 are offset from the lateral edges of the trough which the auxiliary support defines. Snapped over the pegs 44, they secure the combination of the movable blade 3 and its support 5 in the housing 7 under pressure and consequently eliminate any axial play of this combination relative to the fixed blade 2.

Note also that the auxiliary support 6 is formed with ribs 65 on the outside of its bottom bordering the opening 62 and ribs 66 on which the fastening lugs bear. These ribs mechanically reinforce the auxiliary support; the ribs 65 increase the depth of the opening 62 for improved guiding of the tape.

The fixed blade support 4, the movable blade support 5 and the auxiliary support 6 are advantageously molded from a plastics material. In the assembly of the auxiliary support 6 to the first support 4 for the fixed blade, the ends of the sides of the U-shape of the support 4 are retained on the lateral edges of the trough and fastened into the fastening lugs on the auxiliary support 6. In this way deformation of the support 4 is prevented.

Figure 5:
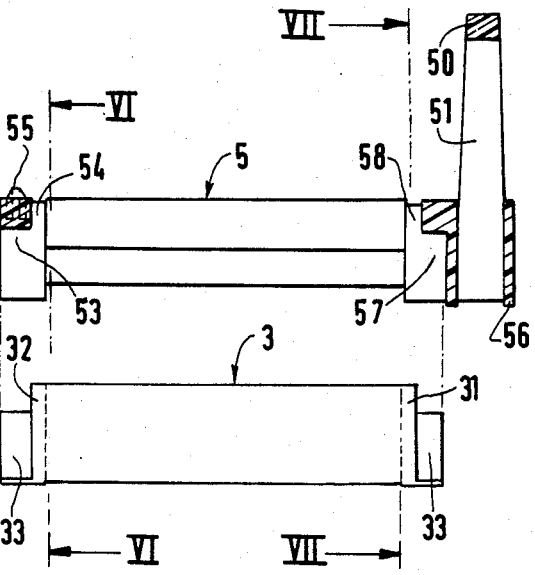
FIG. 5 is an exploded view showing the movable blade of the cutter and its support from the front.
Figure 6:
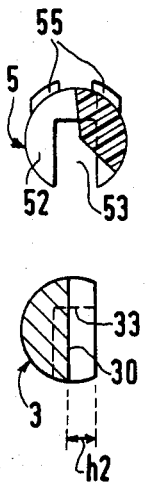
FIGS. 6 and 7 are two views in cross-section on the line VI—VI and the line VII—VII in FIG. 5, respectively.
Figure 7:
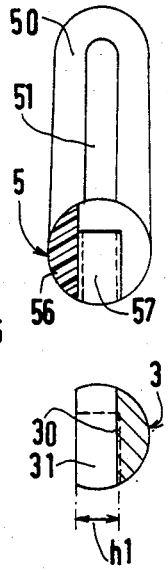
Figure 8:
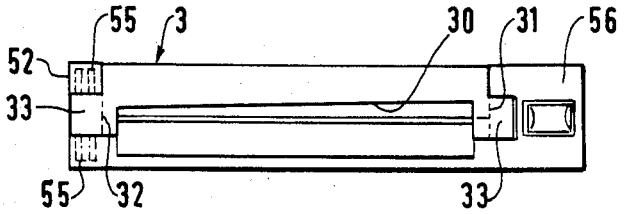
FIG. 8 is a view of the movable blade on its support, from the front.

FIGS. 5 through 7 show the movable blade 3 and its support 5; in FIG. 8 they are shown assembled together.

The mobile blade 3 is of circular segment shape in cross-section. The size of its cross-section increases from one end, the same end as the operating link 50 forming part of its support 5, to the other, as is seen from the two cross-sections of it in FIGS. 6 and 7 and in FIG. 7 where its plane surface 30 is slightly inclined to the horizontal. Because of the plane surface inclined to the horizontal and thus to the fixed blade, the movable blade cuts progressively across the width of the tape.

The movable blade 3 has at its ends two lugs 31, 32 for mounting it on the support 5. These lugs project above the plane surface 30 of the movable blade. They are of different height, denoted h1 and h2 in FIGS. 6 and 7, to compensate for the inclination of the plane surface 30. They are also profiled as shown in the figures each defining an end stub of substantially rectangular cross-section one rounded side of which partially follows the semi-circular edge of the blade.

The support 5 is of circular sector shape cross-section over the length of the movable blade 3 which is comprised between its two lugs 31 and 32. It terminates on one side in a ring 52 of the same radius as and coaxial with the circular sector, featuring a notch 53 with a rectangular bottom opening its periphery. It also features a groove 54 adjacent the ring 52, formed on the plane surfaces of the circular sector cross-section support. This groove 54 and the notch 53 accommodate the lug 32 with its end stub so as to constitute therewith a complete ring. The ring 52 also carries two pegs or ribs 55 on its periphery, these pegs 55 being inserted into the groove 45 on the support 4 for the fixed blade for precise longitudinal positioning of the movable blade and its support in the housing 7.

On the other side, the support 5 terminates in a longer ring 56 of which the more inward part features a notch 57 analogous to the notch 53 and is bordered by a groove 58 analogous to the groove 54, for retaining the other lug 31 and its end stub, the other end part of which carries the link 50 which is molded in one piece with the support 5.

Figure 3:
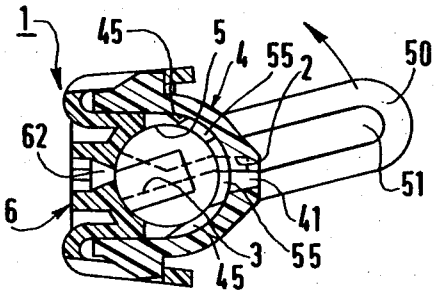
FIG. 3 is a view of the cutter in cross-section on the line III—III in FIG. 1 but showing it during closing.
Figure 1:
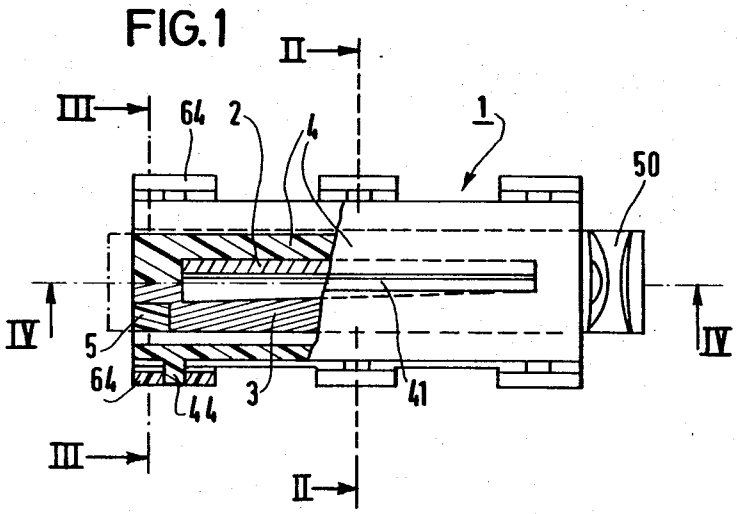
FIG. 1 shows the cutter in accordance with the invention seen from in front and partially cut away.
Figure 4:
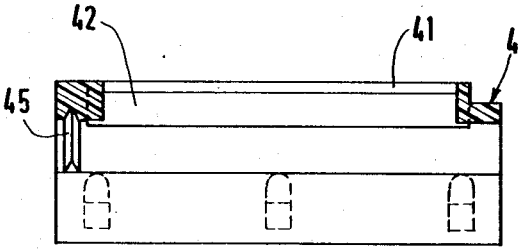
FIG. 4 is a cross-sectional view from below of the support for the fixed blade of the cutter.

The mounting of the blade on its support is in this way made very stable. On its support, the plane surface of the movable blade 3 is, apart from its inclination, substantially parallel to one of the plane surfaces of the circular sector (FIGS. 2 and 3). The gap 70 between them is thus of similar width to the opening 41 in the support 4, on the same side as this opening 41, and diverges rapidly in the direction towards the opening 62 in the support 6. This wide passage 70 leading to the opening 62 ensures free passage of the tape from the outlet from the opening 62 when the cutter is open.

Figure 9:
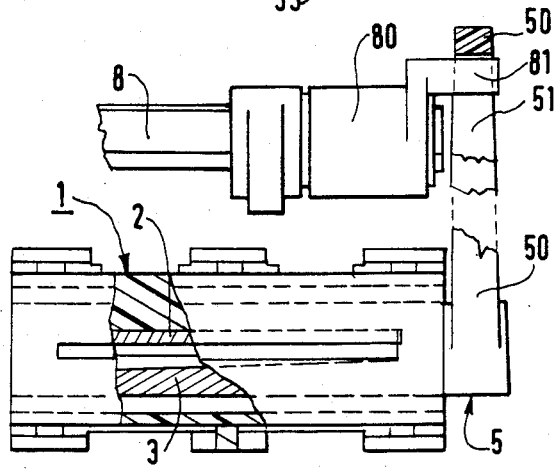
FIG. 9 shows the cutter in accordance with the invention from the front and partially cut away, coupled to its control shaft.

FIG. 9 shows the cutter 1 coupled to a rotating shaft 8 controling it. The coupling is of the crank and crankshaft type and consists of an end ring 80 on the shaft 8 featuring an eccentric tenon 81 engaged in the opening 51 in the link 50 of the support for the movable blade 3. In FIG. 9 the link 50 is elongated as compared with the previous figures to make the drawing more clear. On each complete revolution of the shaft the cutter is closed and returned to its open position.

It will be understood that various changes in the details, materials and arrangements of parts which have been herein described and illustrated in order to explain the nature of the invention may be made by those skilled in the art within the principle and scope of the invention as expressed in the appended claims.

There is claimed:

1. Cutter for cutting material in tape form, comprising a movable blade of circular segment shape in cross-section, a fixed blade, means for mounting said circular segment shape movable blade for movement in front of said fixed blade, a rotating shaft, means for coupling said movable blade to said rotating shaft so as to move it in front of said fixed blade, said mounting means comprising a first support carrying said fixed blade, said first support being U-shaped in cross-section and having a bottom and opposite sides, said first support, at its bottom having a semicircular inside surface, a longitudinal first opening within the bottom of said first support and a groove opening laterally into said first opening from the inside surface of said first support and accommodating said fixed blade, an auxiliary support which is generally trough-shaped and has a bottom which is semi-circular on the inside surface thereof, a second opening within the bottom of the auxiliary support, said auxiliary support having opposite edges inserted between the sides of the U shaped first support, a substantially cylindrical housing for said movable blade defined by said first and auxiliary supports, snap-fastener means carried by said first and auxiliary supports for maintaining pressure on said first and auxiliary supports to limit movement of said movable blade to that of rotation in said housing without axial play, and means operatively coupling said rotating shaft to said movable blade for operating said movable blade to close off said first opening when the cutter is closed and to move said movable blade to the same side of the first and second openings without closing them off, when the cutter is open.

2. The cutter according to claim 1, wherein said movable blade carries two end rings and means carried by one of said end rings and engaging said housing for axially centering said movable blade in its housing.

3. The cutter according to claim 2, wherein one end of said first support is formed with a groove on the inside of the bottom of said first support and one of said end rings carries at least one radially projecting peg at its periphery engaging said groove to position said movable blade longitudinally in its housing and forming said axial centering means.

4. The cutter according to claim 2, wherein one end of said first support is formed with a groove in the inside of the bottom of said first support, one of said end rings carries at least one peg at its periphery engaging said groove to position said movable blade longitudinally in its housing, and said movable blade is mounted on a second support, said second support partially defining said end rings and said movable blade extending between said end rings and forming a gap between said movable blade and said second support.

5. The cutter according to claim 4, wherein said second support between said rings is of circular sector cross-section.

6. The cutter according to claim 5, wherein said movable blade has a plane surface and said second support has multiple plane surfaces and said movable blade plane surface is substantially parallel to one of the plane surfaces of said second support so that said gap beween said movable blade and said second support widens rapidly in the direction towards said second opening.

7. The cutter according to claim 4, wherein said second support comprises a trough, said snap fastener means comprise lugs bordering said trough externally and being offset towards said second support lateral edges and complementary pegs on the outside surfaces of the sides of the U-shaped first support snap fitted to said lugs.

8. The cutter according to claim 1, wherein the cross-section of said movable blade increases in size from one end thereof to the other.

9. The cutter according to claim 1, wherein said coupling means comprises a crank carried by said rotating shaft, and said second support comprises a radially outwardly projecting operating link at one end thereof engaged by said crank.

* * * * *